US009105176B2

(12) United States Patent
Cheng

(10) Patent No.: US 9,105,176 B2
(45) Date of Patent: Aug. 11, 2015

(54) SEARCH DEVICE, ELECTRONIC SYSTEM AND OPERATION METHOD

(71) Applicants: Inventec (Pudong) Technology Corporation, Shanghai (CN); INVENTEC CORPORATION, Taipei (TW)

(72) Inventor: Chia-Min Cheng, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 14/227,901

(22) Filed: Mar. 27, 2014

(65) Prior Publication Data

US 2014/0354424 A1 Dec. 4, 2014

(30) Foreign Application Priority Data

May 30, 2013 (CN) ..... 2013 1 0210695

(51) Int. Cl.
*G08B 1/08* (2006.01)
*G08B 21/24* (2006.01)
*G08B 21/02* (2006.01)

(52) U.S. Cl.
CPC ..... *G08B 21/24* (2013.01); *G08B 21/0208* (2013.01); *G08B 21/0263* (2013.01)

(58) Field of Classification Search
CPC ..... H04W 4/00; G06Q 20/35785; G08B 21/0269; G08B 21/0205; G08B 21/0225
USPC ..... 340/539.11, 572.1, 686.1, 573.1, 502, 340/539.15; 455/39, 404.2, 556.2
See application file for complete search history.

(56) References Cited

U.S. PATENT DOCUMENTS

| | | | | |
|---|---|---|---|---|
| 6,078,260 | A * | 6/2000 | Desch | 340/573.1 |
| 2003/0214411 | A1 * | 11/2003 | Walter et al. | 340/573.4 |
| 2005/0057359 | A1 * | 3/2005 | Coffey et al. | 340/539.21 |
| 2005/0068173 | A1 * | 3/2005 | Capobianco et al. | 340/539.23 |
| 2011/0319022 | A1 * | 12/2011 | Arad et al. | 455/41.2 |

* cited by examiner

*Primary Examiner* — Phung Nguyen
(74) *Attorney, Agent, or Firm* — Locke Lord LLP; Tim Tingkang Xia, Esq.

(57) ABSTRACT

This disclosure provides a search device, a person loss prevention system and an operation method. The person loss prevention system comprises an electronic device and the search device. The search device includes a receiver and a transmitter electrically connected with the electronic device. The person loss prevention system instructs the transmitter to transmit a predetermined signal to the receiver by the operation method. After the receiver receives the predetermined signal, the receiver sends a feedback signal to the electronic device. The electronic device adjusts a waveform of a sound signal according to the feedback signal and transmits the sound signal to the search device. The search device plays the sound signal through a speaker unit. Thereby, the user of the electronic device immediately determines the position, the distance and the direction of the receiver.

10 Claims, 8 Drawing Sheets

SEARCH DEVICE, ELECTRONIC SYSTEM AND OPERATION METHOD

CROSS-REFERENCE TO RELATED APPLICATIONS

This non-provisional application claims priority under 35 U.S.C. §119(a) on patent application No(s). 201310210695.1 filed in China on May 30, 2013, the entire contents of which are hereby incorporated by reference.

BACKGROUND

1. Technical Field

This disclosure relates to a type of search device, electronic system and operation method, especially relates to a type of search device, electronic system and operation method for person loss prevention.

2. Related Art

In the past, if family members, such as young children, ones with dementia, or elderly, get lost and their location, distance, or direction are not found immediately, many more surrounding people, such as passerby, neighbors, friends, or police, have to join in to help locate the lost ones. However, even after spending great manpower and resources in searching the lost ones, the results are often disappointing.

Therefore, some of the person loss prevention systems with distance alert functions have been developed to have two separating parts, the mother device and the search device. This type of person loss prevention system has a mother device with light emitting diode (LED) lights in three directions. These three LED lights provide the user of the mother device with a direction in which to search for the user of the search device. However, since this design only provides three LED lights for direction, it is difficult to determine the position and distance of the user of the search device. This lowers the search effect of the separating type person loss prevention system.

Moreover, the separating type person loss prevention system requires two separate devices, increasing the cost and lowering the portability. This could also lower the willingness of the user to carry and use the devices, leading to the person loss prevention function to be less effective.

Therefore, as more and more people are using person loss prevention systems, developing a person loss prevention method to use with a person loss prevention system that has good portability and effective person loss prevention function, so person loss prevention systems can be carried easily by the user hence improving the person loss prevention effectiveness, becomes an important problem to solve.

SUMMARY

In response to the problem stated above, this disclosure provides a search device, a person loss prevention system and an operation method, to help the user of the system to determine the location, distance, or direction of the user of the search device immediately.

According to one embodiment of the present disclosure, a search device is for use with an electronic device that includes a first transmitting interface and a processing unit. The search device includes a transmitter and a receiver. The transmitter includes a second transmitting interface that is electrically connected to the first transmitting interface, and a first communication unit that is electrically connected to the second transmitting interface. The second transmitting interface receives the predetermined signal from the first transmitting interface and transmits the predetermined signal to the first communication unit. The receiver includes a second communication unit that is wirelessly connected to the first communication unit, a control unit that is electrically connected to the second communication unit, and a speaker unit that is electrically connected to the control unit. The second communication unit receives the predetermined signal through the first communication unit and returns a feedback signal to the electronic device through the first communication unit, the second communication unit and the first transmitting interface. The processing unit of the electronic device sets the waveform of a sound signal and transmits the sound signal to the receiver through the first transmitting interface, the second transmitting interface, the first communication unit, and the second communication unit. The control unit of the receiver commands the speaker unit to play the sound signal.

According to one embodiment of the present disclosure, a person loss prevention system includes an electronic device and a search device. The electronic device includes a first transmitting interface for transmitting a predetermined signal, and a processing unit being electrically connected to the first transmitting interface. The search device includes a transmitter and a receiver. The transmitter includes a second transmitting interface that is electrically connected to the first transmitting interface, and a first communication unit that is electrically connected to the second transmitting interface. The second transmitting interface receives the predetermined signal from the first transmitting interface and transmits the predetermined signal to the first communication unit. The receiver includes a second communication unit that is wirelessly connected to the first communication unit, a control unit that is electrically connected to the second communication unit, and a speaker unit that is electrically connected to the control unit. The second communication unit receives the predetermined signal through the first communication unit and returns a feedback signal to the electronic device through the first communication unit, the second communication unit and the first transmitting interface. The processing unit of the electronic device sets the waveform of a sound signal and transmits the sound signal to the receiver through the first transmitting interface, the second transmitting interface, the first communication unit, and the second communication unit. The control unit of the receiver commands the speaker unit to play the sound signal.

In another embodiment, the electronic device of the person loss prevention system described above further includes an input unit and a storage unit that are electrically connected to the processing unit. The input unit receives a control signal, and the processing unit commands the sound receiving unit to receive the sound signal according to the control signal.

In another embodiment, the electronic device of the person loss prevention system described above further includes an input unit and a storage unit that are electrically connected to the processing unit. The input unit receives a control signal, and the processing unit commands the first transmitting interface to transmit the sound signal stored in the storage unit to second transmitting interface of the transmitter of the search device according to the control signal.

In another embodiment, the processing unit of the electronic device of the person loss prevention system described above sets the waveform amplitude of the sound signal according to the feedback signal.

According to one embodiment of the present disclosure, an operating method of a person loss prevention system includes the steps below. A first transmitting interface transmits a predetermined signal of the person loss prevention electronic system. A second transmitting interface of the person loss prevention electronic system receives the predetermined signal and sends the predetermined signal to the first communication unit. A first communication unit of the person loss prevention electronic system receives the predetermined signal and sends the predetermined signal to the second communication unit. The second communication unit of the person loss prevention electronic system returns a feedback signal through the first communication unit, the second transmitting interface, and the first transmitting interface to a processing unit. The processing unit of the person loss prevention electronic system sets waveform of a sound signal according to the feedback signal and sends the sound signal to a speaker unit through the first transmitting interface, the second transmitting interface, the first communication unit, and the second communication unit. The speaker unit of the person loss prevention electronic system plays the sound signal.

In another embodiment, in the operation method mentioned above, before the step of the processing unit of the person loss prevention electronic system sets waveform of the sound signal according to the feedback signal and sends the sound signal to the speaker unit through the first transmitting interface, the second transmitting interface, the first communication unit, and the second communication unit, the method further comprises an input unit of the person loss prevention electronic system receives a control signal, and the processing unit commands a sound receiving unit to receive the sound signal according to the control signal.

In another embodiment, in the operation method mentioned above, before the step of the processing unit of the person loss prevention electronic system sets waveform of the sound signal according to the feedback signal and sends the sound signal to the speaker unit through the first transmitting interface, the second transmitting interface, the first communication unit, and the second communication unit, the method further comprises an input unit of the person loss prevention electronic system receives a control signal, and the processing unit commands a storage unit to store the sound signal according to the control signal.

In another embodiment, in the operation method mentioned above, before the step of the processing unit of the person loss prevention electronic system sets waveform of the sound signal according to the feedback signal and sends the sound signal to the speaker unit through the first transmitting interface, the second transmitting interface, the first communication unit, and the second communication unit, the method further comprises a processing unit of the electronic device sets waveform of the sound signal according to the feedback signal.

BRIEF DESCRIPTION OF THE DRAWINGS

The present disclosure will become more fully understood from the detailed description given herein below for illustration only, and thus does not limit the present disclosure, wherein.

DETAILED DESCRIPTION

Figure 1:
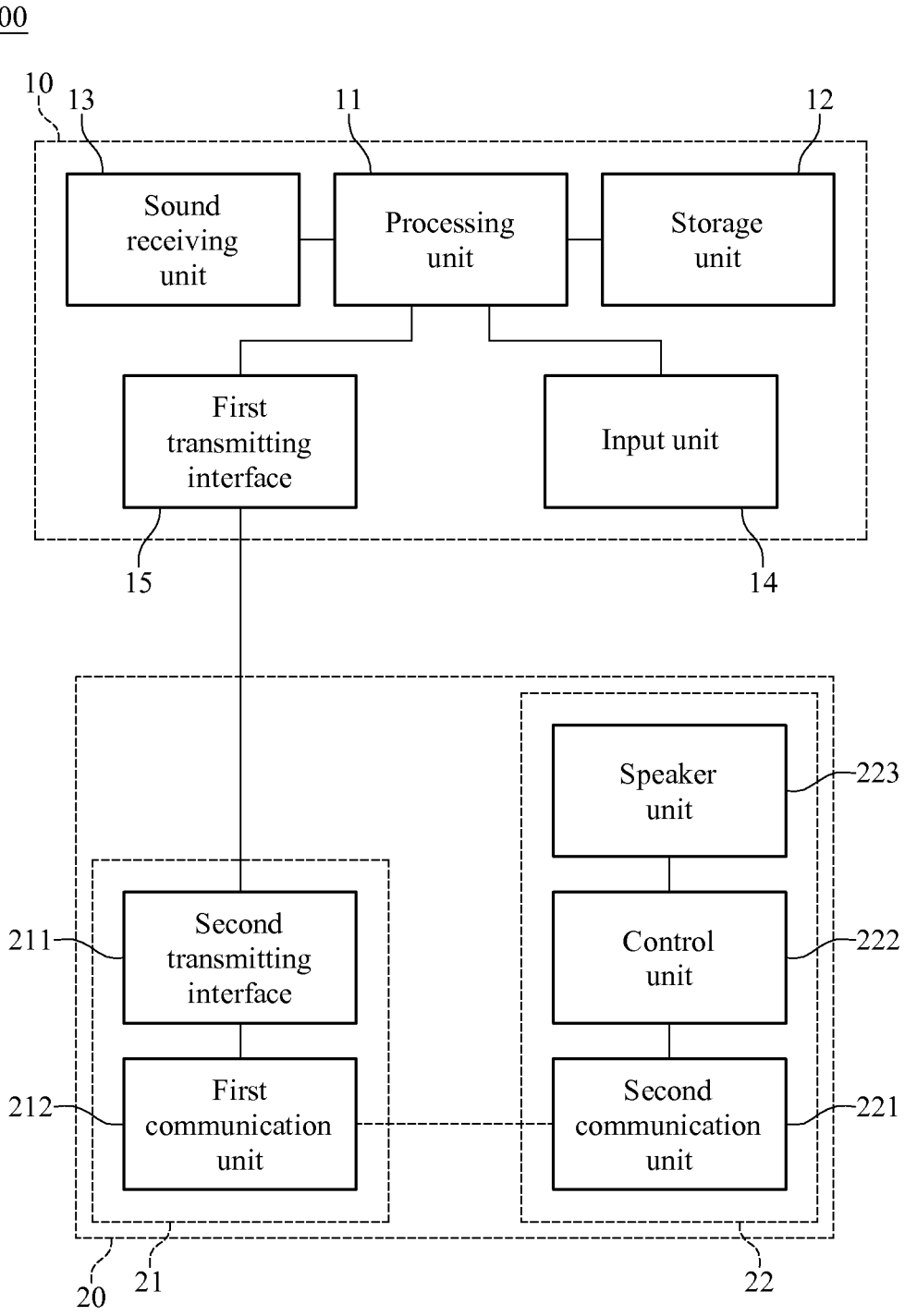
FIG. 1 is a block diagram of a person loss prevention system according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Please refer to FIG. 1, which is a block diagram of a person loss prevention system according to an embodiment of the disclosure. A person loss prevention system 100 includes an electronic device 10 and a search device 20. The electronic device 10 can be a mobile phone, desktop computer, laptop computer, or personal digital assistant (PDA). The electronic device 10 includes a processing unit 11, and a storage unit 12 electrically connected to the processing unit 11, a sound receiving unit 13, an input unit 14, and a first transmitting interface 15. The processing unit 11 of the electronic device can be a Central Processing Unit (CPU).

The storage unit 12 can be a hard disk or a memory device. The hard disk can be grouped as Advanced Technology Attachment hard disk, Serial Advanced Technology Attachment hard disk, Small Computer System Interface hard disk, Serial Attached SCSI hard disk, and Solid State Disk (SSD), etc. according to the data transmission interface. The memory device can be grouped as Dynamic Random Access Memory, (DRAM), Static Random Access Memory (SRAM), Electrically Erasable Programmable Read-Only Memory (EEPROM), and Erasable Programmable Read-Only Memory, (EPROM), etc. according to the difference in the technical design. But the storage unit 12 is not limited to these stated examples.

The sound receiving unit 13 can be a microphone. In one embodiment of the present disclosure, the input unit 14 can be computer accessories, such as touch panel screen, mouse, or keyboard, etc. The first transmitting interface 15 can be a Universal Serial Bus (USB) port, a headphone connection port, or a headphone jack. The headphone connection port can be grouped by the connecting plug diameter into groups of 3.5 mm, 2.5 mm, or 6.3 mm, etc. The first transmitting interface 15 is for transmitting a predetermined signal to a search device 20.

The search device 20 includes a transmitter 21 and a receiver 22. The transmitter 21 includes a second transmitting interface 211 that is electrically connected to the first transmitting interface 15, and a first communication unit 212 that is electrically connected to the second transmitting interface 211. The second transmitting interface 211 receives the predetermined signal from the first transmitting interface 15 and transmits the predetermined signal to the first communication unit 212.

The second transmitting interface 211 can be a Universal Serial Bus (USB) port, a headphone connection port, or a headphone jack. The first communication unit 212 can be a communication device of Bluetooth, infrared, or Near Field Communication (NFC), etc.

The receiver 22 includes a second communication unit 221 that is wirelessly connected to the first communication unit 212, a control unit 222 that is electrically connected to the second communication unit 221, and a speaker 223 unit that is electrically connected to the control unit 222. The second communication unit 221 according to one embodiment of the present disclosure can be a communication device of Bluetooth, infrared, or Near Field Communication (NFC), etc. The control unit 222 is a central processing unit. The speaker unit 223 is a speaker device. But the search device 20 of one embodiment of the present disclosure is not limited to these stated examples.

The explanation below will explain the operation of the person loss prevention system 100 in detail.

Figure 2A:
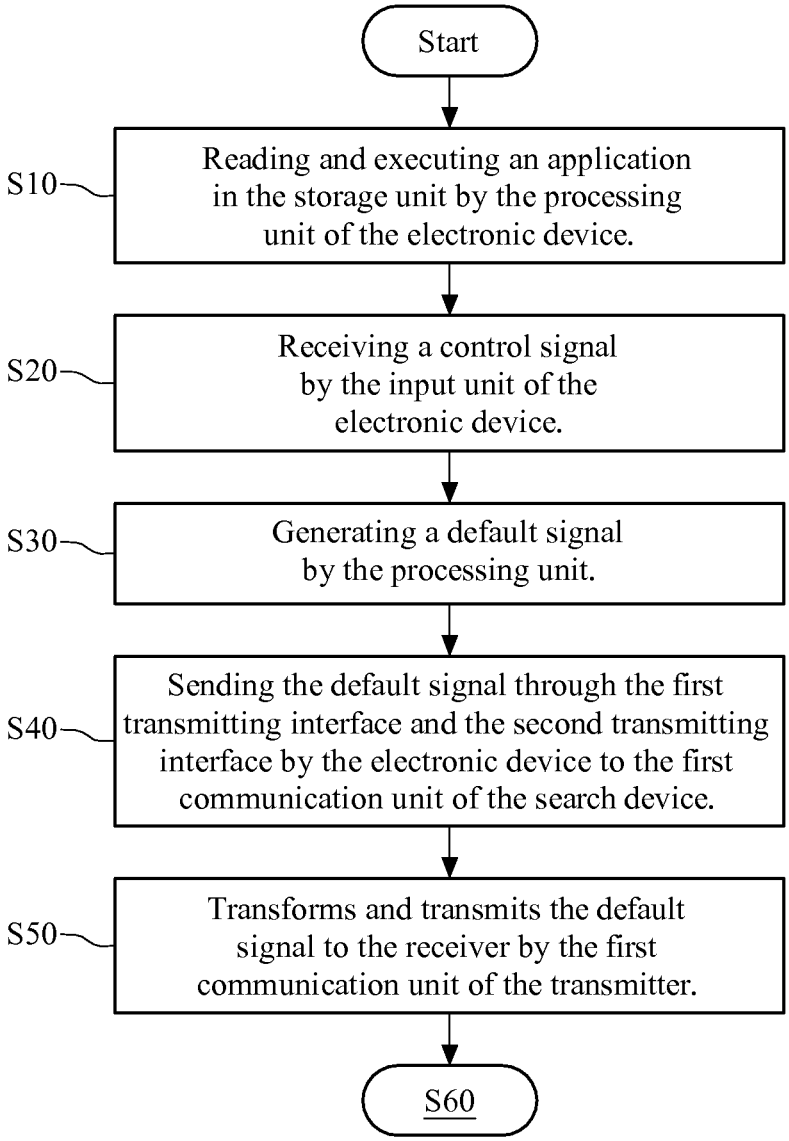
FIG. 2A is a partial flowchart of an operating method according to an embodiment of the disclosure.
Figure 2B:
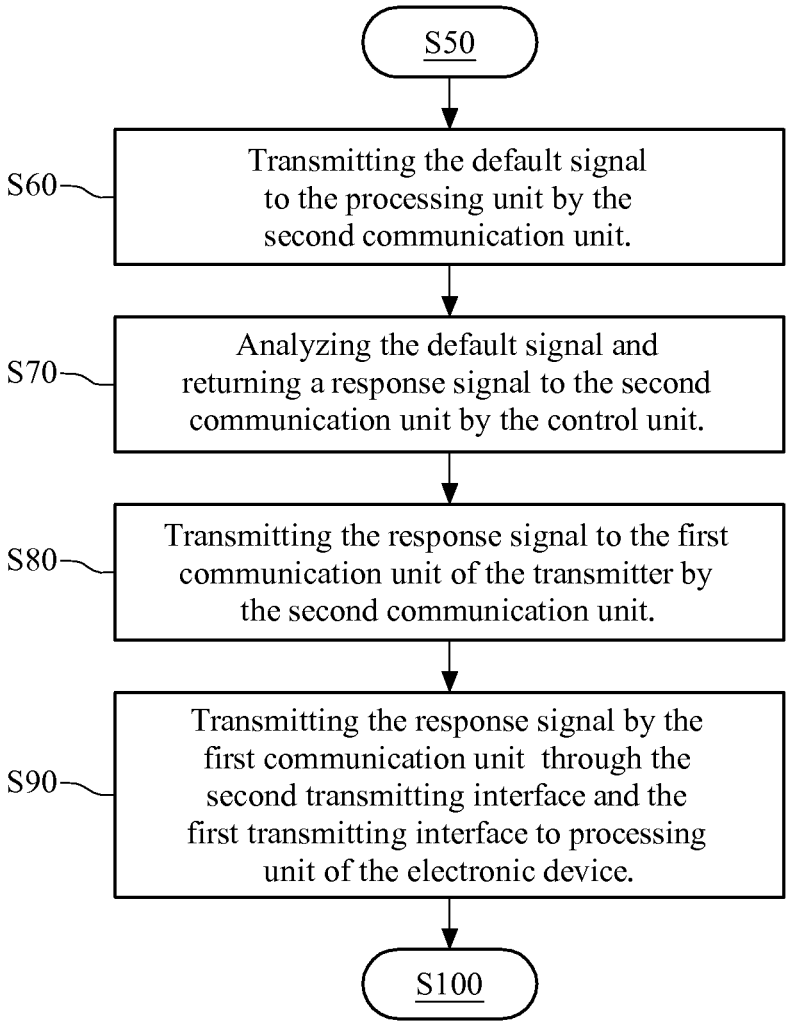
FIG. 2B is a partial flowchart of an operating method according to an embodiment of the disclosure.

Please refer to FIG. 1, FIG. 2A, and FIG. 2B. FIG. 2A is a partial flowchart of an operating method according to an embodiment of the disclosure. FIG. 2B is a partial flowchart of an operating method according to an embodiment of the disclosure. An operating method according to an embodiment of the disclosure includes the steps shown below. Step S10: The processing unit 11 of the electronic device 10 reads and executes an application in the storage unit 12. In this step, the electronic device 10 can download an application from the internet or a CD-ROM drive, and store the application in the storage unit 12. After the electronic device 10 calls and executes the application from the storage unit 12, the electronic device 10 can execute the operation method of the person loss prevention system 100 through the application and provide a menu for the user to utilize. The menu can include function options such as voice call or alarm search, but are not limited to these.

Step S20: The input unit 14 of the electronic device 10 receives a control signal. In this step, the user chooses functions such as the voice call or alarm search through the input unit 14 of the electronic device 10 to produce the control signal.

Step S30: the processing unit 11 generates a predetermined signal. In this step, as soon as the input unit 14 of the electronic device 10 receives the control signal, the processing unit 11 generates and transmits the predetermined signal to a first transmitting interface 15.

Step S40: The electronic device 10 sends the predetermined signal through the first transmitting interface 15 and the second transmitting interface 211 to the transmitter 21 of the search device 20. The devices are designed this way because the transmitter 21 of the search device 20 includes the second transmitting interface 211 and the first communication unit 212, and therefore has a lower volume and a lighter weight. Also, the search device 20 can be easily integrated with electronic devices 10 such as mobile phones, desktop computers, laptop computers, or tablet computers through the second transmitting interface 211 and the USB port or headphone plug on the electronic devices 10. This effectively integrates the search device 20 and the electronic device 10, increasing the efficiency of the person loss prevention system 100.

Step S50: The first communication unit 212 of the transmitter 21 transforms and transmits the predetermined signal to the receiver 22. In this step, the first communication unit 212 of the transmitter 21 transforms the predetermined signal to be of a wirelessly transmittable format, and then transmits the predetermined signal of the wirelessly transmittable format through wireless communication methods such as Bluetooth, infrared, wireless network, or NFC, to the second communication unit 221 of the receiver 22. In this way a wireless transmitting function between the transmitter 21 of the search device 20 and the receiver 22 is achieved.

Step S60: The second communication unit 221 transmits the predetermined signal to the control unit 222 and enters Step S70.

Step S70: The control unit 222 analyses the predetermined signal and returns a response signal to the second communication unit 221. In this step, the control unit 222 analyses the predetermined signal and interprets the predetermined signal only represents that the electronic device 10 has started operating the person loss prevention function, then responds with the response signal to the second communication unit 221.

Step S80: The second communication unit 221 transmits the response signal to the first communication unit 212 of the transmitter 21.

Step S90: The first communication unit 212 transmits the response signal through the second transmitting interface 211 and the first transmitting interface 15 to processing unit 11 of the electronic device 10.

Figure 3:
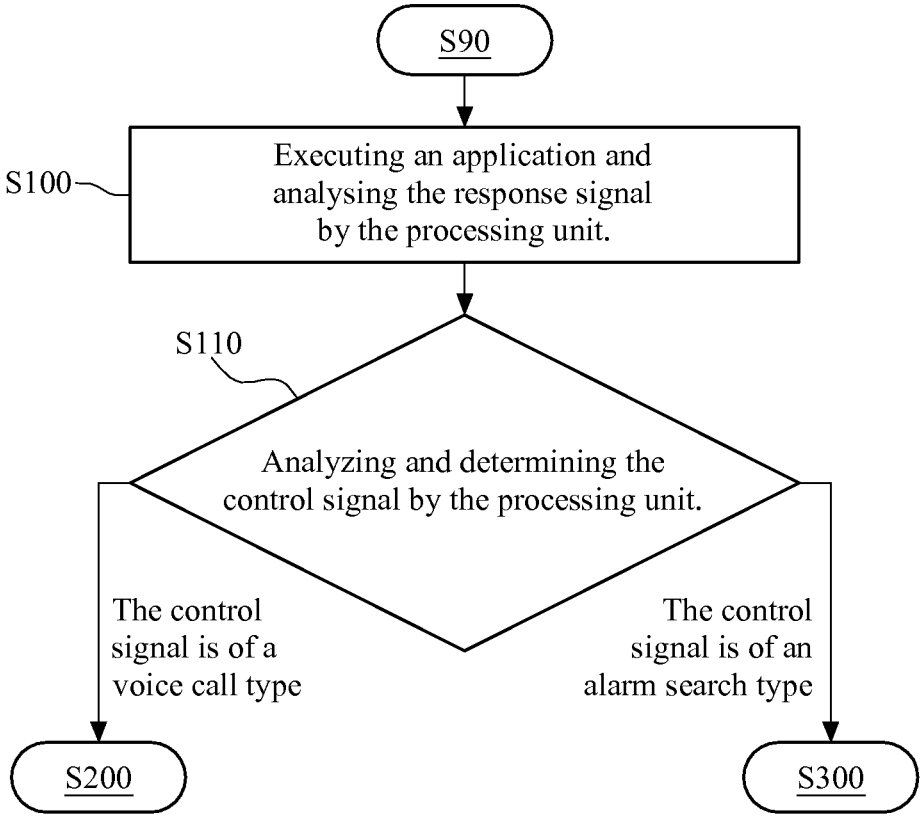
FIG. 3 is a flowchart of an operating method according to an embodiment of the disclosure.

Please refer to FIG. 1, FIG. 2A, FIG. 2B, and FIG. 3. FIG. 3 is a flowchart of an operating method according to an embodiment of the disclosure. Step S100: The processing unit 11 executes an application and analyses the response signal. In this step, the processing unit 11 analyses the response signal to decipher the distance between the transmitter 21 of the search device 20 and the receiver 22. The processing unit 11 further records this analysis result as a distance signal.

Step S110: The processing unit 11 analyses and determines the control signal. In this step, the processing unit 11 analyses and determines the control signal and uses the result to determine whether the control signal is a voice call or alarm search function. If the control signal represents the voice call function, the system then enters step S200. If the control signal represents the alarm search function, the system then enters step S300.

Figure 4:
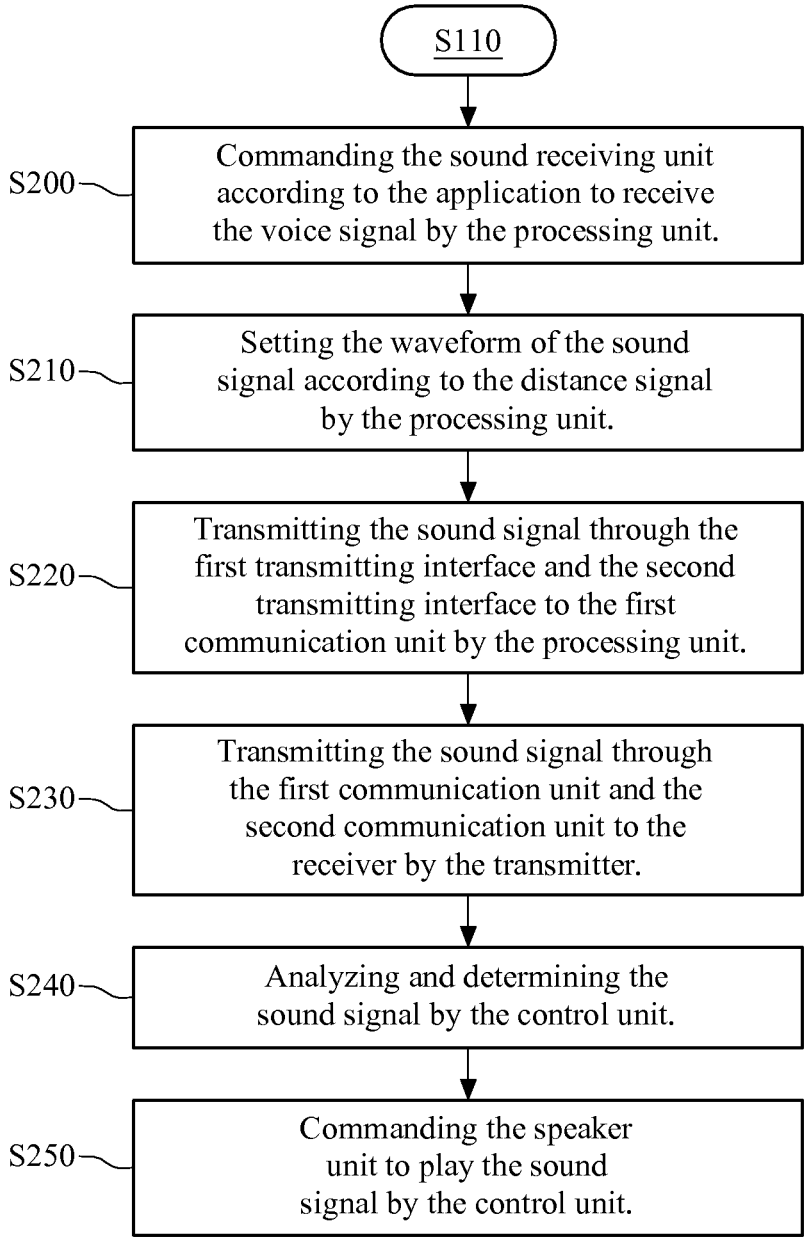
FIG. 4 is a flowchart of an operating method according to an embodiment of the disclosure.

Please refer to FIG. 1 and FIG. 4. FIG. 4 is a flowchart of an operating method according to an embodiment of the disclosure. Step S200: The processing unit 11 commands the sound receiving unit 13 according to the application to receive the sound signal.

Step S210: The processing unit 11 sets the waveform of the sound signal according to the distance signal. In this step, the processing unit 11 can set the wave shape, frequency, or amplitude of the sound signal according to the distance signal. This way, when the distance between the transmitter 21 and the receiver 22 of the search device 20 is further, the processing unit 11 increases the wave amplitude of the sound signal, causing the sound signal to have a higher volume when played. When the distance between the transmitter 21 of the search device 20 and the receiver 22 is closer, the processing unit 11 decreases the wave amplitude of the sound signal, causing the sound signal to have a lower volume when played. Of course, the processing unit 11 can also set according to the distance signal the wave shape or frequency of the sound signal to achieve the most optimized notice effect, and is not limited to the examples listed above.

Step S220: The processing unit 11 transmits the sound signal through the first transmitting interface 15 and the second transmitting interface 211 to the first communication unit 212.

Step S230: The transmitter 21 transmits the sound signal through the first communication unit 212 and the second communication unit 221 to the receiver 22.

Step S240: The control unit 222 analyses and determines the sound signal. In this step, the control unit 222 analyses and determines that the sound signal is a voice to be played, then enters step S250.

Step S250: The control unit commands the speaker unit to play the sound signal.

An advantage of this design lies in that the users of the transmitter 21 and the receiver 22 of the search device 20 can achieve a good interaction. In other words, the user of the receiver 22 can listen to the sound signal from the user of the transmitter 21, and actively search for the location of the user of the transmitter 21, thus achieving person loss prevention results. In more details, when the users of the transmitter 21 and the receiver 22 are located not too far apart, the user of the transmitter 21 can hear the receiver play the sound signal at a lower volume. On the other hand, when the users of the transmitter 21 and the receiver 22 are located further apart, the user of the transmitter 21 can hear the receiver play the sound signal at a higher volume. This way, no matter the distance, the user of the transmitter 21 can hear the sound signal played at an appropriate volume and determines immediately according to the sound signal the location, distance, or direction of the user of the receiver 22, hence greatly increasing the person loss prevention effect.

Figure 5:
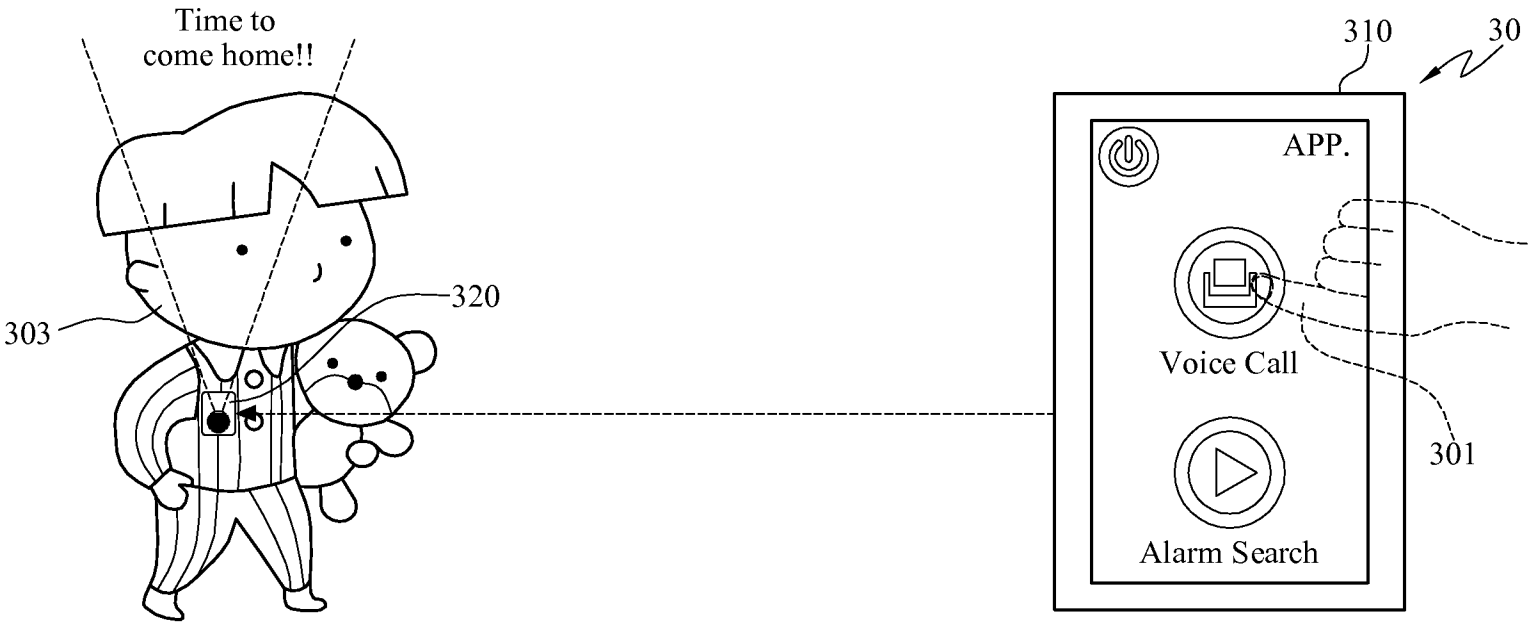
FIG. 5 is a system operating flowchart of a person loss prevention system according to an embodiment of the disclosure.

Please refer to FIG. 5 for an actual operation of the method. FIG. 5 is a system operating flowchart of a person loss prevention system according to an embodiment of the disclosure. As shown in FIG. 5, the person loss prevention system 30 includes an electronic device 310 held by a first user (for example, the parents) and a receiver 320 of a search device held by a second user 303 (for example, a child). When the first user wants to tell the second user 303 to perform specific tasks, for example "it's time to come home" or "come to the entrance of the restaurant," the first user can select with a finger 301 the "voice call" option on the electronic device 310. Then the electronic device 310 starts to receive a sound signal inputted by the first user. And when the first user finishes inputting the sound signal, for example, when the first user selects the "voice call" button again or when the electronic device 310 has not sensed any voice for certain time duration, the electronic device 310 sends the received recorded sound signal to the receiver 320 of the search device. When the receiver 320 of the search device receives this recorded sound signal, the receiver 320 of the search device then plays this sound signal aloud. Thus the second user 303 can clearly listen to the specific task the first user intends to communicate.

Figure 6:
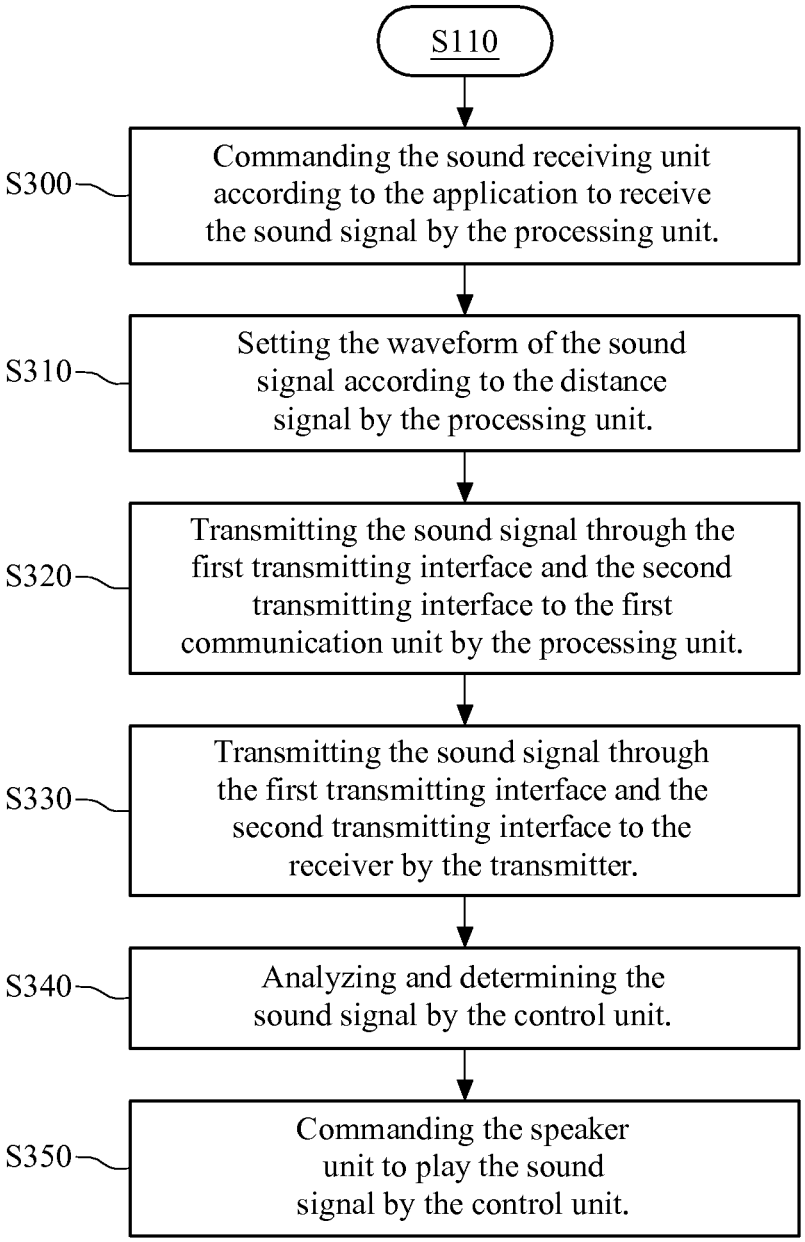
FIG. 6 is a flowchart of an operating method according to an embodiment of the disclosure.

Please refer to FIG. 1 and FIG. 6. FIG. 6 is a flowchart of an operating method according to an embodiment of the disclosure.

Step S300: The processing unit 11 receives the sound signal from the storage unit 12 according to the application.

Step S310: The processing unit 11 sets the waveform of the sound signal according to the distance signal.

Step S320: The processing unit 11 transmits the sound signal through the first transmitting interface 15 and the second transmitting interface 211 to the first communication unit 212.

Step S330: The transmitter 21 transmits the sound signal through the first communication unit 212 and the second communication unit 221 to the receiver 22.

S340: The control unit 222 analyses and determines the sound signal.

S350: The control unit 222 commands the speaker unit 223 to play the sound signal.

An advantage of this design lays in that the user of the transmitter 21 or the receiver 22 of the search device 20 can record beforehand various sound signals, or use the sound signals provided by the system, for example, beeping alarm signals, hence improving the convenience of using the person loss prevention system 100.

Figure 7:
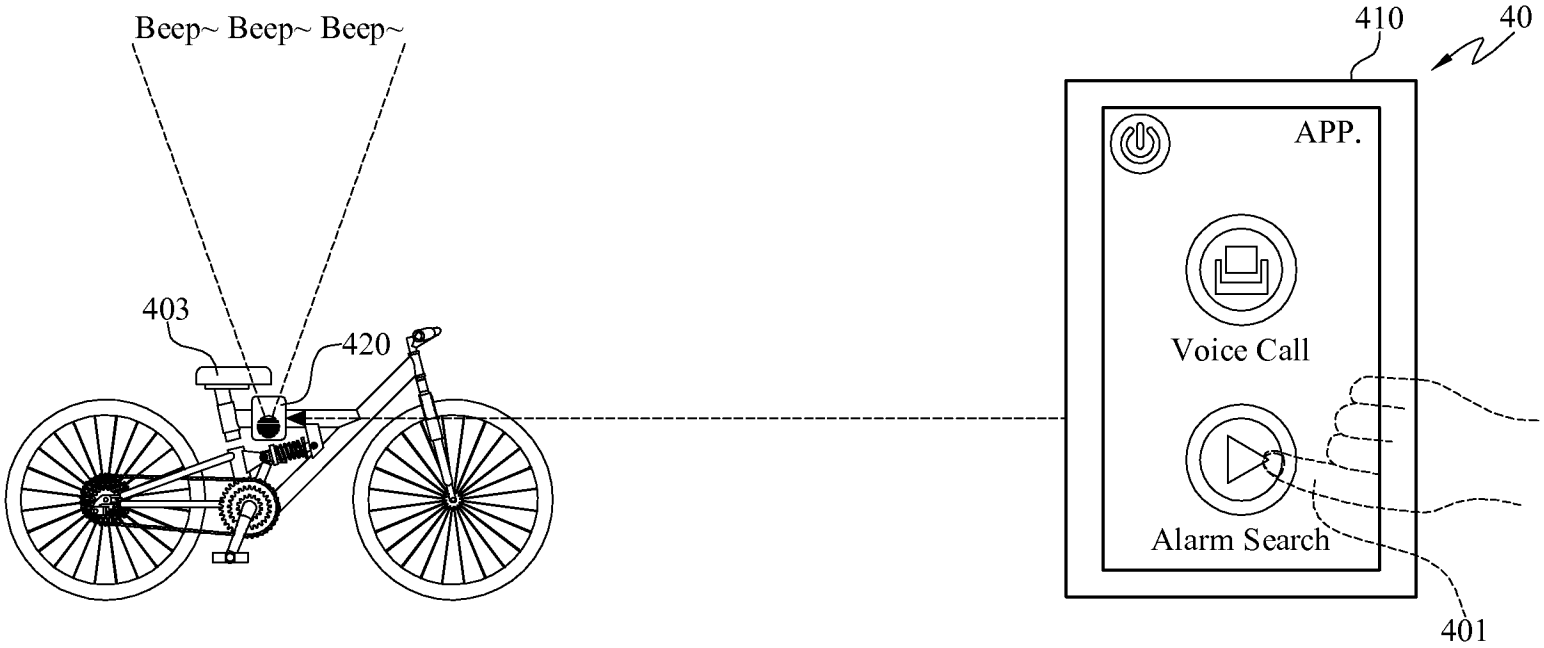
FIG. 7 is a system operating flowchart of a person loss prevention system according to an embodiment of the disclosure.

For an actual operation method, please refer to FIG. 7. FIG. 7 is a system operating flowchart of a person loss prevention system according to an embodiment of the disclosure. As shown in FIG. 7, the person loss prevention system 40 includes an electronic device 410 held by a first user and a receiver 410 of the search device that is placed on a vehicle 403 (for example, a bicycle.) When the first user intends to search for the vehicle 403, the first user selects with a finger 401 the "alarm search" option on the electronic device 410. Then the electronic device 410 detects the distance of the receiver 420 of the search device, and sets the waveform of a sound signal according to the detected distance. And then the electronic device 410 sends the sound signal to the receiver 420 of the search device. When the receiver 420 of the search device receives this recorded sound signal, the receiver 420 of the search device then plays the sound signal aloud. Thus the first user can locate the vehicle 403 according to the sound signal played aloud.

In summary, users can achieve a good person loss prevention effect with the search device and person loss prevention system provided by the present disclosure. Some advantages of the search device, the person loss prevention system and the operation method of the present disclosure include adjusting the waveform of the sound signal to effectively notify the transmitter with the location, distance, or direction of the user of the receiver. Moreover, the user of the receiver can actively search for the user of the transmitter according to the sound signal played, achieving a good two-way notifying function. Further more, through the second transmitting interface of the transmitter of the search device can be directly integrated to the electronic device by the first transmitting interface of the electronic device. This can increase the portability and convenience of the search device, and also increase the utilization of the person loss prevention system, achieving the purpose of this disclosure.

What is claimed is:

1. A person loss prevention electronic system, comprising:

an electronic device, comprising a first transmitting interface for transmitting a predetermined signal, and a processing unit being electrically connected to the first transmitting interface; and a search device, comprising:

a transmitter, having a second transmitting interface being electrically connected to the first transmitting interface, and a first communication unit being electrically connected to the second transmitting interface, the second transmitting interface receiving the predetermined signal and transmitting the predetermined signal to the first communication unit; and a receiver, having a second communication unit being wirelessly connected to the first communication unit, a control unit being electrically connected to the second communication unit, and a speaker unit being electrically connected to the control unit;

wherein the second communication unit receives the predetermined signal through the first communication unit and returns a feedback signal to the electronic device through the first communication unit, the second communication unit and the first transmitting interface, the processing unit of the electronic device sets the waveform of a sound signal and transmits the sound signal to the receiver through the first transmitting interface, the second transmitting interface, the first communication unit, and the second communication unit, and the control unit of the receiver commands the speaker unit to play the sound signal.

2. The person loss prevention electronic system of claim 1, wherein the electronic device further comprises an input unit and a sound receiving unit that are electrically connected to the processing unit, where the input unit receives a control signal, and the processing unit commands the sound receiving unit to receive the sound signal according to the control signal.

3. The person loss prevention electronic system of claim 1, wherein the electronic device further comprises an input unit and a storage unit that are electrically connected to the processing unit, where the input unit receives a control signal, and the processing unit commands the first transmitting interface to transmit the sound signal stored in the storage unit to second transmitting interface of the transmitter of the search device according to the control signal.

4. The person loss prevention electronic system of claim 1, wherein the processing unit of the electronic device sets the waveform amplitude of the sound signal according to the feedback signal.

5. A search device, for use with an electronic device that has a first transmitting interface and a processing unit, the search device comprises:

A transmitter, comprising a second transmitting interface that is electrically connected to the first transmitting interface, and a first communication unit that is electrically connected to the second transmitting interface, where the second transmitting interface receives the predetermined signal and transmits to the first communication unit; and a receiver, comprising a second communication unit that is wirelessly connected to the first communication unit, a control unit that is electrically connected to the second communication unit, and a speaker unit that is electrically connected to the control unit; the second communication unit receives the predetermined signal through the first communication unit and returns a feedback signal to the electronic device through the first communication unit, the second transmitting interface and the first transmitting interface, the processing unit of the electronic device sets the waveform of a sound signal and transmits the sound signal to the receiver through the first transmitting interface, the second transmitting interface, the first communication unit, and the second communication unit, and the control unit of the receiver commands the speaker unit to play the sound signal.

6. The search device of claim 5, wherein the second communication unit of the receiver is wirelessly connected to the first communication unit through Bluetooth, infrared, wireless network, or near field communication.

7. An operating method of a person loss prevention electronic system, for use with the person loss prevention electronic system, the operating method comprises the following steps:

transmitting a predetermined signal by a first transmitting interface of the person loss prevention electronic system;

receiving the predetermined signal and sending the predetermined signal to the first communication unit by a second transmitting interface of the person loss prevention electronic system;

receiving the predetermined signal and sending the predetermined signal to the second communication unit by a first communication unit of the person loss prevention electronic system;

returning a feedback signal by the second communication unit of the person loss prevention electronic system through the first communication unit, the second transmitting interface, and the first transmitting interface to a processing unit;

setting the waveform of a sound signal according to the feedback signal by the processing unit of the person loss prevention electronic system and sending the sound signal to a speaker unit through the first transmitting interface, the second transmitting interface, the first communication unit, and the second communication unit processing unit; and playing the sound signal by the speaker unit of the person loss prevention electronic system.

8. The operating method of claim 7, wherein before the step of setting the waveform of the sound signal according to the feedback signal and sending the sound signal to the speaker unit through the first transmitting interface, the second transmitting interface, the first communication unit, and the second communication unit by the processing unit of the person loss prevention electronic system, the method further comprises receiving a control signal by an input unit of the person loss prevention electronic system, and commanding a sound receiving unit to receive the sound signal according to the control signal by the processing unit.

9. The operating method of claim 7, wherein before the step of setting the waveform of the sound signal according to the feedback signal and sending the sound signal to the speaker unit through the first transmitting interface, the second transmitting interface, the first communication unit, and the second communication unit by the processing unit of the person loss prevention electronic system, the method further comprises receiving a control signal by an input unit of the person loss prevention electronic system, and receiving the sound signal from a storage unit according to the control signal by the processing unit.

10. The operating method of claim 7, wherein before the step of setting the waveform of the sound signal according to the feedback signal and sending the sound signal to the speaker unit through the first transmitting interface, the second transmitting interface, the first communication unit, and the second communication unit by the processing unit of the person loss prevention electronic system, the method further comprises setting the waveform of the sound signal according to the feedback signal by the processing unit of an electronic device.

* * * * *